United States Patent [19]

Reprogle et al.

[11] Patent Number: 4,641,596

[45] Date of Patent: Feb. 10, 1987

[54] BOAT DOCK AND LIFT

[76] Inventors: Layton J. Reprogle, 4430 Emminence, Berkeley, Mo. 63134; Truman B. Reprogle, 6442 Vita, Affton, Mo. 63123

[21] Appl. No.: 740,424

[22] Filed: Jun. 3, 1985

[51] Int. Cl.[4] ..... B63C 3/06

[52] U.S. Cl. ..... 114/44; 114/365; 405/3

[58] Field of Search ..... 114/365-374, 114/44, 51; 405/1-7, 221; 414/678; 187/20, 26, 9 R; 254/386, 387, 397, 398

[56] References Cited

U.S. PATENT DOCUMENTS

| | | | |
|---|---|---|---|
| 3,177,668 | 4/1965 | Schneider | 405/3 |
| 3,191,389 | 6/1965 | Poe | 114/44 |
| 3,284,052 | 11/1966 | Godbersen | 405/3 |
| 3,362,172 | 1/1968 | Rutter | 405/3 |
| 4,236,695 | 12/1980 | Morrison | 254/386 |
| 4,432,664 | 2/1984 | Baldyga | 405/3 |
| 4,482,268 | 11/1984 | Stevenson | 114/44 |
| 4,516,478 | 5/1985 | Connelly | 254/386 |

*Primary Examiner*—Sherman D. Basinger
*Assistant Examiner*—C. T. Bartz
*Attorney, Agent, or Firm*—Polster, Polster and Lucchesi

[57] ABSTRACT

A boat dock and lift is disclosed in which an upright frame is provided having a pair of spaced upright members and a horizontal cross member therebetween. A lift is movably mounted on the frame. The lift has a support engageable with a boat hull and a pair of generally vertical arms movably mounted on the frame uprights. A compound pulley and cable arrangement is mounted on the horizontal cross member of the frame. This pulley and cable arrangement includes a first pulley block stationary with respect to the frame, and a second pulley block movable horizontally along the cross member. A first cable is secured to the frame, is entrained around certain of the pulleys on the first and second pulley block, and is secured to one of the lift uprights. A second cable is also secured to the frame, entrained around others of the pulleys on the first and second pulley blocks, and is secured to the other lift upright. A hydraulic cylinder is secured between the frame and the movable pulley block such that upon actuation of the hydraulic cylinder, horizontal movement of the second pulley block is effected along the cross member toward and away from the first pulley block thereby to take up or let out the cables, and thereby to move both of the lift upright members an equal distance in vertical direction along the frame uprights so as to ensure that the lift support and a boat supported thereon remain in generally horizontal position as the lift is raised and lowered.

5 Claims, 4 Drawing Figures

BOAT DOCK AND LIFT

BACKGROUND OF THE INVENTION

This invention relates to a boat dock and boat lift, and more particularly to such a combination dock and lift which has a lift movable between a lowered position below the surface of the water in which a boat may be floated into position above the lift, and a raised position in which a boat supported on the lift is lifted clear of the water.

More generally, it is a relatively common practice to remove smaller pleasure boats, such as outboard runabouts and the like, from the water when not in use so as to prevent the growth of marine life (e.g., barnacles and plant life) on the submerged portion of the boat hull. It is well known that such marine life must be periodically removed from the boat hull, or the performance of the boat will deteriorate markedly due to higher drag as the boat is propelled through the water. In order to prevent the growth of marine life on the hull of relatively small boats, the boats are oftentimes hoisted from the water when not in use. The hoisting of the boat from the water also enables the ready cleaning of the boat.

A variety of boat lifts or hoists are known. Heretofore, one such hoist involved a pair of davits which were secured to a dock or sea wall, and which extended out over the water. Block and tackle arrangements were carried by the end of the davits which, in turn, were connected to the bow and stern of the boat. By taking in or letting out the ropes or cables on the block and tackle arrangements, the bow and stern of the boat may be raised or lowered. However, such block and tackle davit lifting devices would raise or lower the bow or stern of the boat independently of one another. Thus, either two persons were required to raise or lower the boat, or one end of the boat could only be raised a relatively short distance (e.g., a foot or so), then that block and tackle arrangement secured while the other end was loosened and raised or lowered an appropriate amount so as to maintain the boat in a generally horizontal position as it was raised or lowered from the water.

Other boat lifting devices were known in which the above-described block and tackle arrangements were replaced by a horizontal pipe journaled on the ends of the davits, with a pair of cables attached to the pipe at each end thereof proximate the davits, and with the cables being connected to the bow ano stern of the boat. Upon rotation of the journaled pipe, as by means of a large hand wheel affixed to one end thereof, the pipe served as a winch which would uniformly raise or lower both ends of the boat substantially simultaneously. Of course, in place of the hand wheel, a motorized drive may be employed.

However, the use of such lifting cables required that the boat to be lifted have sufficient structural strength at both ends of the boat, together with hardware of sufficient strength, such that the weight of the boat can be supported by the bow and stern hardware and structure.

Other boat dock and lift apparatus were known in which an upright frame was provided adjacent the water, with the frame being secured to a dock or sea wall. The frame included two spaced upright beam members and a lift movably supported on the upright beams and having a pair of generally horizontal arms which extended outwardly from the beams forming a cradle engageable with the hull of a boat. A cradle arrangement was oftentimes provided on the horizontal lift arm so as to conform to the shape of the boat hull and to solidly support the boat in a generally horizontal position. The lift was moved between a lowered position in which the lifting arms and the cradles carried thereby were below the surface of the water so that a boat to be lifted may be floated in place above the raised position in which the boat hull supported on the cradle is lifted clear of the water. The lift arms were moved between their raised and lowered positions by means of a winch and cable arrangement driven by two independent electric motor and gear sets driving a respective winch. However, because the effective diameter of the cable wrapped around the winches, and because the speeds of the two motors may vary slightly, it was not possible to ensure that both sides of the lift would be raised or lowered uniformly such that the lift with the boat supported thereon would remain substantial horizontal as it was raised and lowered. Further, the provision of gear speed reducers coupled to each of the motors for driving the winches in a salt water environment resulted in the requirement of frequent maintenance and repair of these prior winch-operated boat docks and lifts.

SUMMARY OF THE INVENTION

Among the several objects and features of the present invention may be noted the provision of a combination boat dock and lift which requires only one motor for raising and lowering a cradle-type lift support, and which ensures that both sides of the lift support are moved uniformly so as to maintain the lift support and a boat carried thereby in a generally horizontal position as the lift is raised and lowered;

The provision of such a lift in which the lifting mechanism and the power supply therefor is located at the top of the lifting device so as to minimize salt water corrosion;

The provision of such a lift which is of rugged and economical construction, which is easy to install, which has a long service life, and which is reliable in operation.

Other objects and features of the present invention will be in part apparent and in part pointed out hereinafter.

Briefly stated, a boat dock and lift of the present invention comprises a frame having a pair of spaced upright members and a horizontal cross member extending between the upper end portions of the upright members. This frame may be mounted to a suitable dock, sea wall, or the like, adjacent a body of water. A lift is mounted on the frame, with this lift having a support engageable with the boat hull. The lift and the support are movable between a lowered position in which the support is below the surface of the water such that a boat to be lifted may be floated into position above the support, and a raised position in which the support engages the boat hull from below and lifts the boat clear of the water. The lift has a pair of upright arms, with each of these arms being in generally face-to-face relation with a resective one of the frame upright members. Means is provided for movably mounting the lift upright arms on the frame upright members to facilitate movement of the lift between its raised and lowered positions. Additionally, means is carried by the frame cross member and connected to the lift upright arms for moving the lift between its raised and lowered positions while maintaining the support and the boat supported thereon in a generally horizontal position. This lift-moving means comprises a piston and cylinder unit having one end thereof fixed with respect to the frame, and having its other end movable with respect to the frame. A first pulley block is secured to the frame, and a second pulley block is slidable on the frame and is connected to the other end of the piston and cylinder unit. Each of these pulley blocks has a plurality of pulleys journaled thereon. A first flexible cable having one end thereof is secured with respect to the frame and is entrained around certain of the pulleys of the first and second pulley blocks, and has its other end secured to one of the lift uprights. A second flexible cable has one of its ends secured with respect to the frame, and it is entrained around others of the pulleys of the first and second pulley blocks and further has its other end secured to the other of the lift uprights so that upon actuation of the piston and cylinder unit, the second pulley block is forceably moved toward and away from the first pulley block thereby to move the other ends of the first and second cables an equal distance in generally vertical direction so as to ensure that the lift is maintained in its desired generally horizotal position as it is moved between its raised and lowered positions.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
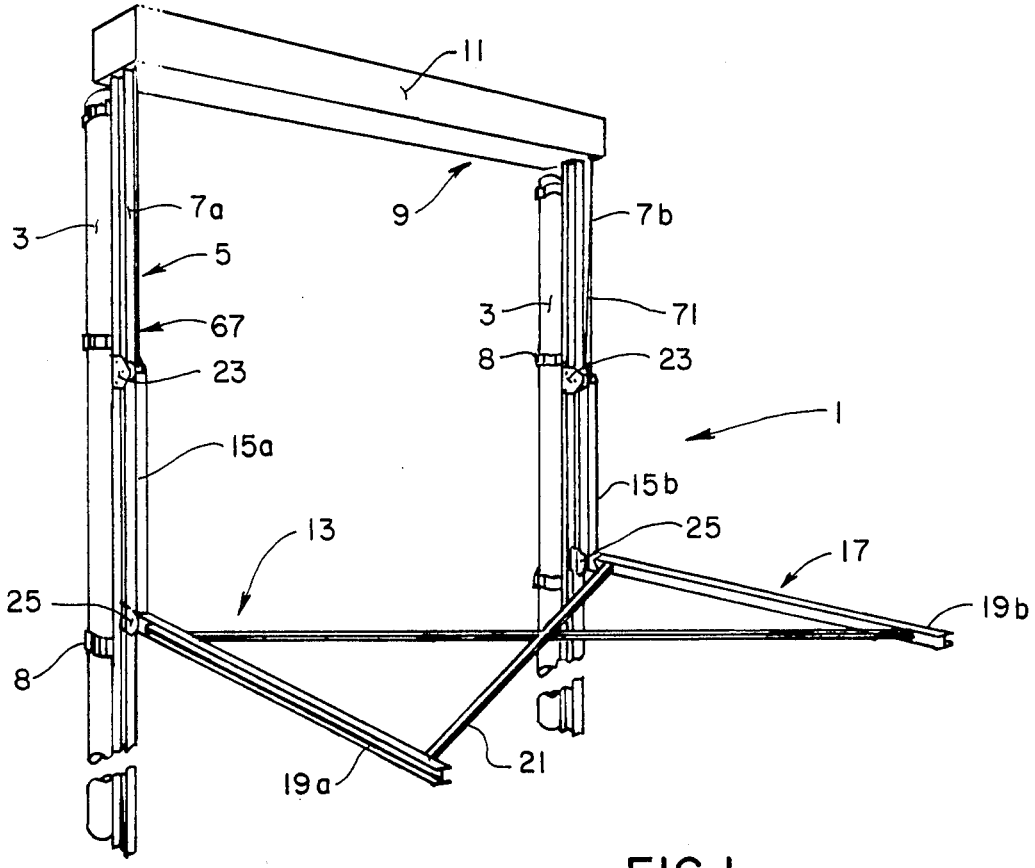
FIG. 1 is a perspective view of the boat dock and lift of the present invention, installed on a pair of upright piers or supports adjacent a body of water, and illustrating a frame and a lift vertically movable relative to the frame.

Referring now to the drawings, a boat dock and lift apparatus of the present invention is illustrated in its entirety by reference character 1. As shown, the boat dock and lift are mounted on an appropriate structure, such as piers 3, solidly mounted proximate a body of water (e.g., a lake or a bay), and sunk sufficiently deep in the bottom such that the water is of sufficient depth to float a boat (not shown) into position above a portion of lift 1 of the present invention. It will be understood that the pier 3 may constitute a portion of a dock or, alternatively, other structure (not shown) may be provided adjacent the water, mounted on a sea wall or the like for securement of the boat dock and lift 1 of the present invention thereto.

More specifically, boat dock and lift 1 comprise a frame, as generally indicated at 5, consisting of a pair of spaced, upright members *7a, 7b* of I-beam construction. A frame cross member 9 is secured to and extends between the upper ends of the frame upright *7a, 7b*. As indicated at 11, a cross member cover of fiberglass or the like encloses cross member 9, and encloses a cable and pulley lifting mechanism mounted on cross member 9, as will be hereinafter described in detail.

A lift, as generally indicated at 13, is movably mounted on frame uprights *7a, 7b*. The lift includes a pair of lift upright arms 15*a*, 15*b*, with each of these upright arms being disposed parallel to and in front of a corresponding frame upright *7a, 7b*. The lift further includes a horizontal support, as generally indicated at 17, cantilevered from the lower ends of lift upright arms 15*a*, 15*b*. More specifically, support 17 includes a pair of generally horizontal support arms 19*a*, 19*b*, with an X-brace 21 extending between the inner and outer ends of the horizontal support arms 19*a*, 19*b*. As will be appreciated, a boat cradle (not shown) may be secured to the upper faces of support arms 19*a*, 19*b* so as to cradle the hull of a boat (not shown) from below, and to support the weight of the boat on support 17. Upper roller assemblies 23 are secured to the upper ends of lift upright arms 15*a* and 15*b*, and lower slides 25 are carried by the lower ends of the lift upright arms. These rollers and slides are engageable with the flanges of the I-beam frame uprights *7a, 7b* to facilitate raising and lowering of lift 13 in a manner as will be hereinafter pointed out so as to minimize friction of the lift as it travels on frame 5.

Figure 3:
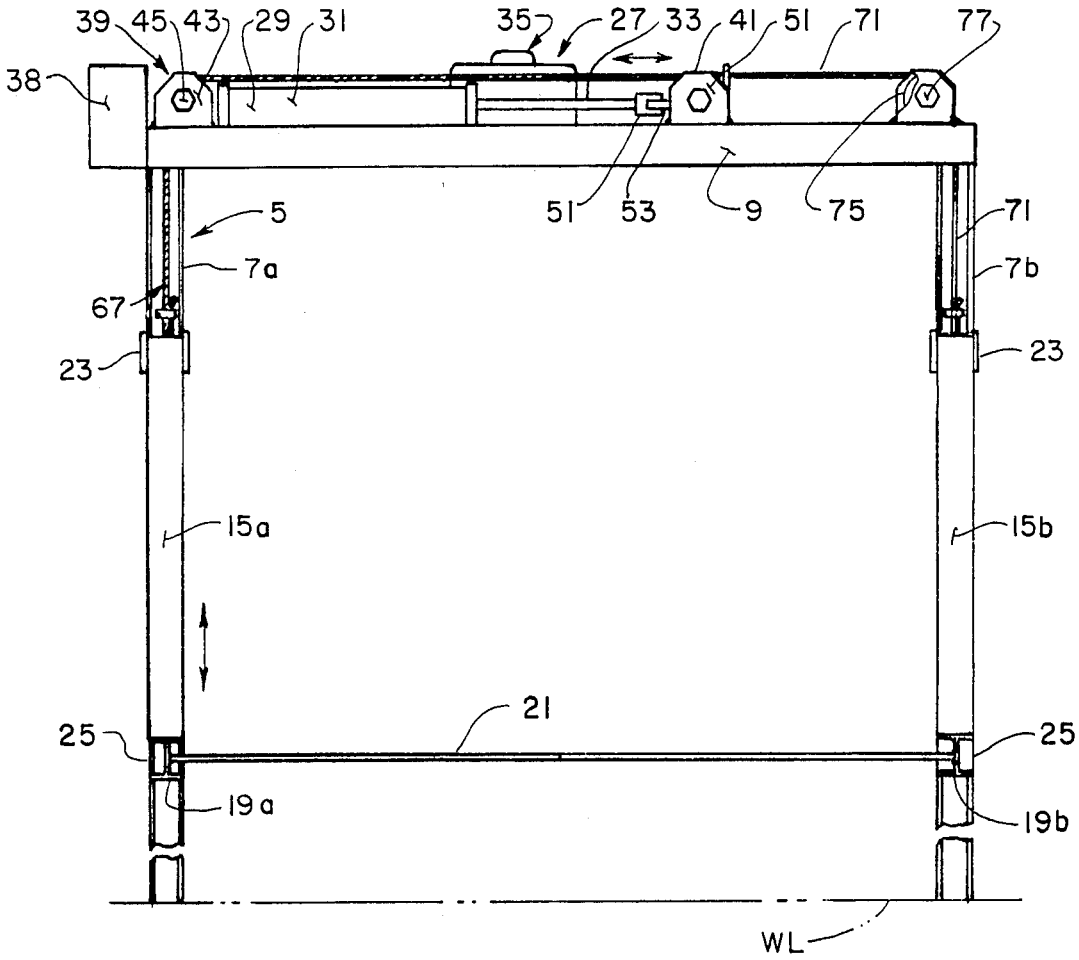
FIG. 3 is a front elevational view of the boat dock and lift, as shown in FIG. 1, with the lift in its raised position above the surface of the water.
Figure 4:
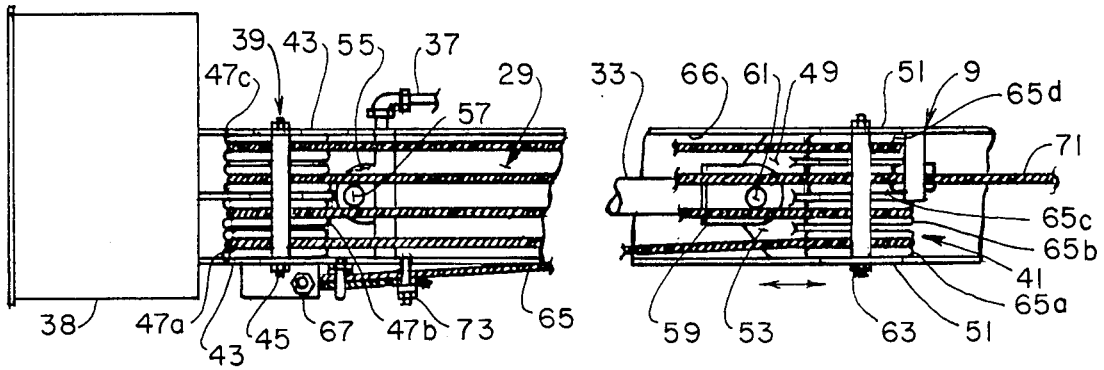
FIG. 4 is a top plan view of FIG. 3, on a somewhat enlarged scale, illustrating the construction of the pulley and cable arrangement utilized to raise and lower the lift.

As generally indicated at 27, means is provided for selectively moving lift 13 between a raised position (as shown in FIG. 3), in which lift arms 15*a*, 15*b* (and any boat supported thereon) is above water level WL, and a lowered position (not shown) in which the support arms 19*a*, 19*b* are disposed below water level WL a sufficient depth such that a boat to be lifted may be floated into position above support 17 for engagement of the hull of the boat by support arms 19*a*, 19*b* (or by the cradle carried thereby) as the lift is moved from its lowered toward its raised position thereby to lift the boat clear of the water. More specifically, raising and lowering means 27 includes a hydraulic piston and cylinder unit, as generally indicated at 29, including a cylinder body 31 and a piston rod 33 extending endwise therefrom. An electric motor and hydraulic pump unit, as generally indicated at 35, is mounted on cross member 9 and is interconnected to the rod and cylinder ends of cylinder body 31 by means of suitable hydraulic hoses 37. Operation of electric motor and hydraulic pump assembly 35 is controlled by a control unit, as generally indicated at 38. It will be appreciated that in a preferred embodiment, energization of electric motor and pump assembly 35 may be remote-controlled via a radio transmitter, and the direction of movement of lift 13 may likewise be controlled by having control unit 38 open and close appropriate solenoid valves (not shown) incorporated in hydraulic hoses 37 so as to manage the inflow and outflow of hydraulic fluid into the ends of cylinder body 31 such that piston rod 33 is either forcefully extended or retracted. Means 27 further includes a fixed or first pulley block, as generally indicated at 39, secured to one end of cross member 9, and a second or movable pulley block, as generally indicated at 41, slidably mounted on cross member 9 for horizontal movement in the direction of the arrows shown in FIGS. 3 and 4 along the top surface of cross member 9, toward and away from the first pulley block 39.

More specifically, the first pulley block 39 is comprised of a pair of sheave plates 43 secured to cross member 9 and spaced apart from one another. A pulley shaft 45 is supported by sheave plates 43, and a plurality of pulleys 47*a*–47*d* are journaled independently of one another on pulley shaft 45 for purposes as will appear. Moveable pulley block 41 comprises a base plate 49 having side plates 51 extending upwardly therefrom. The inner end of base plate 49 has a lug 53 extending inwardly therefrom toward hydraulic cylinder unit 29. Cylinder body 31 has a pair of cylinder lugs 55 integral therewith which are secured to a suitable fitting rigidly secured to cross member 9 by a pin 57. A clevis 59 is carried by the outer end of rod 33, and the clevis is secured to lug 53 on base plate 49 by a pin 61. A pulley shaft 63 extends between side plates 51 of the movable pulley block 41, and a plurality of pulleys 65*a*–65*c* are journaled independently of one another on pulley shaft 63. As indicated at 66, a track for movable pulley block 41 is provided on the upper face of cross member 9, with the movable pulley block being slidable along track 66 between an extended position (as shown in FIG. 3) in which it is distal from stationary pulley block 39, and a retracted position (not shown) in which it is closer to stationary pulley block 39.

Figure 2:
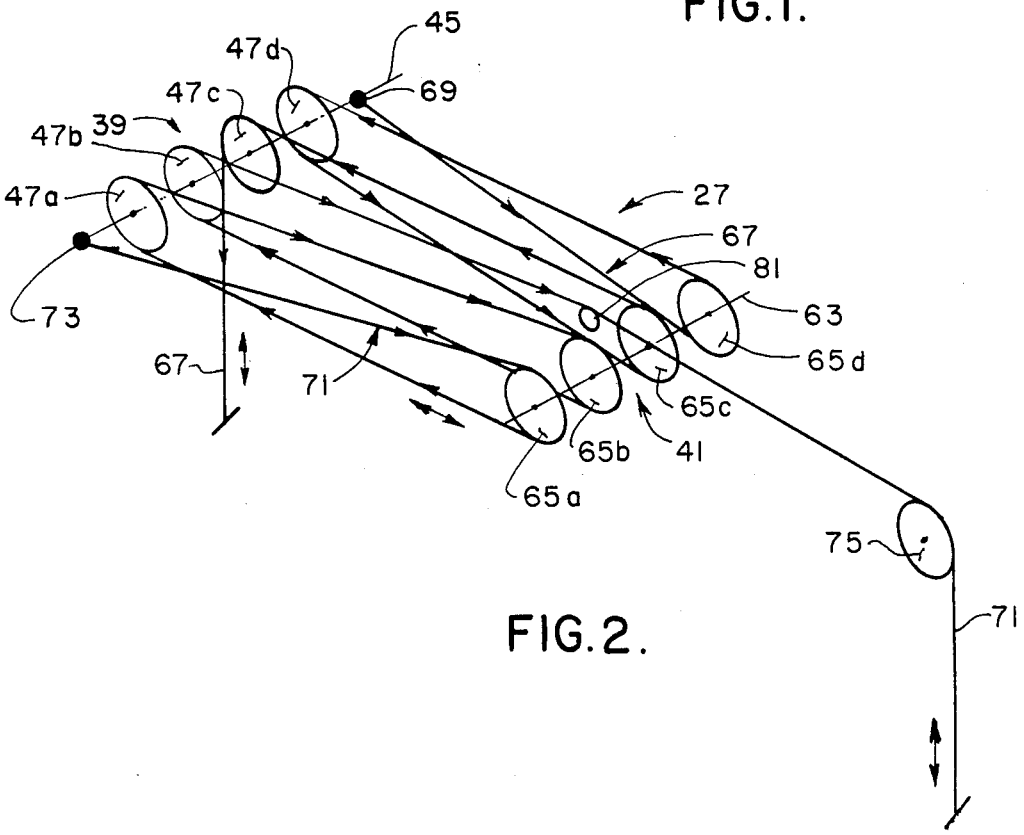
FIG. 2 is a diagrammatic view of a cable and pulley arrangement utilized to uniformly lift both sides of the lift on the frame and to maintain the lift in generally horizontal position as it is moved between its raised and lowered positions.

As best shown in FIG. 2, a first cable 67 is secured relative to frame 5, as indicated at 69, and is entrained around certain pulleys of pulley blocks 39 and 41, and is attached to frame upright member 15*a* proximate the upper roller assembly 23 mounted on the lift upright arm 15*a*. More specifically, cable 67 is secured to cross member 9 by means of a cable clamp 69*a*, and extends to the lower portion of pulley 65*d* on the movable pulley block 41. This first cable is entrained around pulley 65*d*, and extends from the top of pulley 65*d* in generally horizontal, tangential direction, and is entrained around pulley 47*d* of stationary pulley block 39. Further, cable 67 extends from the bottom of pulley 47*d* to the bottom of pulley 65*c* on movable pulley block 41, and is entrained around pulley 65*c*. The first cable thence extends from the upper surface of pulley 65*c* to another pulley 47*c* on pulley block 41, with this last-mentioned pulley 47*c* serving as an idler pulley. Pulley 47*c* is disposed such that cable 67 extends generally vertically downwardly from pulley 47*c* for connection to lift upright arm 45*a*.

The second cable 71 is secured to cross member 9 by means of a cable clamp 73, and extends from the cable clamp over the top of pulley 65*a* on movable pulley block 41. Cable 71 is entrained around pulley 65*a* and extends from the bottom of pulley 65*a* to the bottom of pulley 47*a* on stationary pulley block 39. Thence, cable 71 extends from the top of pulley 47*a* to the top of pulley 65*b* on movable pulley block 41, around pulley 65*b* to the bottom of pulley 47*b* on the stationary pulley block. Cable 71 extends from the top of pulley 47*b* to an idler pulley 75 mounted on cross beam 9 and extends generally vertically downwardly from idler pulley 75 for attachment to the upper end of lift upright arm 15*b* of lift 13. Idler pulley 75 is supported by a pair of spaced side plates 77 secured to cross member 9 and is journaled on a pulley shaft 79 supported by side plate 77. An optional idler pulley 81 carried by movable pulley block 41 is engageable with cable 71 so as to deflect the path of cable 71 upwardly above the levels of pulleys 65*a*–65*d* included within movable pulley block 41.

It will be appreciated, with cables 67 and 71 entrained around their respective pulleys of pulley blocks 39 and 41, as above described, with the cables secured to upright arms 15*a* and 15*b*, as above-described, and with substantially all slack taken out of both cables, movement of movable pulley block 41 in horizontal direction along track 66 on frame cross member 9 by extension and retraction of rod 33 of hydraulic cylinder unit 29, the vertical reaches of cables 67 and 71 attached to lift 13 will be simultaneously moved through substantially the same distance so as to uniformly raise and lower upright lift arms 15*a* and 15*b*. In this manner, lift movement means 27 ensures that both sides of lift 13 will be raised a uniform amount in such manner as to prevent one side of the lift from rising or lowering faster than the other side of the lift, and thereby preventing racking or binding of the lift 13 on frame 5, as it is moved between its raised and lowered positions.

Further in accordance with this invention, the hydraulic cylinder unit 29 utilized in actuation means 27, prevents undue mechanical loads from being transferred from the hydraulic cylinder unit to either lift 13 or to frame 5 such that these loads are not reacted into either the lift or the frame but, instead, are transferred from the piston and rod 33 of the cylinder unit back into cylinder body 31 when rod 33 is either fully retracted or fully extended. First, it will be appreciated that track 66 is preferably of a length somewhat greater than the stroke of hydraulic cylinder unit 29 such that movement of movable pulley block 41 is limited by the stroke of the hydraulic cylinder unit and not by the length of track 66. Further, it will be understood that lift 13 is free to move in vertical direction along frame uprights 7*a*, 7*b* a distance greater than the distance through which the lift is moved upon actuation of means 27, and upon movable slide block 41 moving through its full stroke, as controlled by hydraulic cylinder unit 29. In this manner, if control system 36 is actuated, for example, to fully raise lift 13, hydraulic fluid will be admitted into the cylinder end of cylinder body 31 so as to extend rod 33 toward the right (as shown in FIG. 3), and so as to move pulley block 41 to the right. This will have the effect of moving cables 67 and 71 upwardly, and thus raising lift 13. Upon hydraulic cylinder unit 29 moving the full extent of its stroke, the piston (not shown) sealably movable within cylinder body 31 will abut the end of the cylinder 29 and the end of the cylinder will resist all of the hydraulic pressure forces exerted on the piston which are in excess of the force required to hold lift 13 and any load (e.g., a boat) carried by the lift. It will be noted that excessive loads are thus prevented from being transferred from the hydraulic cylinder unit into either frame 5 or into lift 13. Likewise, upon admitting hydraulic fluid under pressure into the rod end of cylinder body 31, and by releasing fluid from the cylinder end of the cylinder body, retraction of rod 33 is effected which in turn moves pulley block 41 from right to left, as shown in FIG. 3, thus shortening the length of the cables between the movable pulley block 41 and stationary pulley block 39, and thus extending cables 67 and 71, which in turn effects lowering of lift 19 from its raised position toward its lowered position. As rod 33 is fully retracted, the piston within cylinder body 31 engages the cylinder end of cylinder body 31, and the cylinder body absorbs excess hydraulic forces exerted into the cylinder unit without placing undue structural loads on either frame 5 or lift 13. In this manner, the full force of hydraulic cylinder unit 29 may be utilized to lift or lower the lift, without fear of applying excessive loads to either the frame or the lift in the event the movable pulley block moves to either end of its desired stroke.

It will also be appreciated that the cable and pulley arrangement above described for each of the cables 67 and 61, as they are entrained around the pulleys of pulley blocks 39 and 41, effect greater movement of cables 67 and 71 attached to lift 13 through a substantially greater distance than pulley block 41 is moved relative to stationary pulley block 39. For example, since each of the cables 67 and 71 is entrained around two pulleys on each of the pulley blocks, the distance lift 13 is moved in vertical direction is twice the distance movable pulley block is moved on track 66. Greater or lesser amounts of pulley movement relative to pulley block movement may be achieved by changing the number of pulleys around which each of the cables 67 and 71 are entrained on each of the pulley blocks.

In operation, with lift 13 in its lowered position such that support 17 is disposed below water level WL a distance sufficient such that a boat (not shown) can be floated into position over the support, electric motor and hydraulic pump unit 35 is actuated via control 36 such that hydraulic fluid under pressure is admitted into the cylinder end of cylinder body 31, and such that outward movement of piston rod 33 relative to the cylinder body is effected, thereby to move movable pulley block 41 away from stationary pulley block 39. This draws cables 67 and 71 up into the cable and pulley arrangement 27, and forceably raises lift 13 on frame 5. It will be understood that limit switches may be provided along frame 5 for stopping movement of lift 13 when it reaches its fully raised or fully lowered position. Additionally, a safety lock (not shown) may be provided which locks lift 13 relative to frame 5 when the lift is in its raised position such that the weight of the lift and the boat supported thereby need not be carried by cables 67 and 71. To lower the lift and the boat supported thereon, control system 36 is energized momentarily to again fully raise the lift 13 relative to the frame, and to permit the unlatching of the above-described safety lock. Then, hydraulic fluid under pressure is admitted into the rod end of cylinder body 31, and hydraulic fluid is released from the cylinder end of the cylinder body thereby to forcefully move pulley block 41 toward stationary pulley block 39, and to thus reduce the length of cables 67 and 71 entrained around the pulleys of the pulley blocks, and to permit the cables 67 and 71 extending downwardly to lift 13 to extend thereby to lower the lift from its raised position toward its lowered position. As support arms 19*a*, 19*b* move below the water level WL, the boat (not shown) supported on the support 17 will again float on the water, ready for use.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A boat dock and boat lift comprising a frame having a pair of spaced upright members and a horizontal cross member extending between said upright members, a lift mounted on said frame, said lift having a support engageable with a boat hull, said lift being movable between a lowered position in which said support is below the surface of the water such that a boat may be floated into position above said support, and a raised position in which said support engages said boat hull from below and lifts the boat clear of the water, said lift having a pair of upright arms each of which is in generally face-to-face relation with a respective one of said frame upright members, means for movably mounting said lift upright arms on said frame upright members as said lift is moved between its raised and lowered positions, and means carried by said frame and connected to said lift upright arms for moving said lift between its raised and lowered position while maintaining said support in a generally horizontal position, this last said moving means comprising a piston and cylinder unit having one end thereof fixed with respect to said cross member, and the other end thereof movable with respect to said cross member, a first pulley block secured to said cross member, a second pulley block slidable on said cross member and connected to said other end of said piston and cylinder unit, each of said pulley blocks having one or more pulleys journaled thereon, a first flexible cable having one end thereof secured with respect to said frame and being entrained around certain of said pulleys on said first and decond pulley blocks, and having its other end secured to one of said lift upright arms, and a second flexible cable having one end thereof secured with respect to said frame and being entrained around others of said pulleys on said first and second pulley blocks and having its other secured to the other end of said lift upright arms so that upon actuation of said piston and cylinder unit, said second pulley block is forceably moved on said cross member toward or away from said first pulley block thereby to move the other ends of said first and second cables an equal distance in generally vertical direction so as to ensure that said lift is maintained in its above said horizontal position as it is moved between its raised and lowered positions.

2. A boat dock and lift as set forth in claim 1 further comprising a first pulley journaled with respect to said cross member in position such that with said cable entrained thereon, said first cable extends generally vertically downwardly for connection to said one lift upright, and a second pulley journaled with respect to said cross member in position such that with said second cable entrained thereon, said second cable extends generally vertically downwardly for connection to said other lift upright.

3. A boat dock and lift as set forth in claim 1 wherein said first and second pulley blocks each have the same number of pulleys thereon around which is first and second cables are entrained.

4. A boat dock and lift as set forth in claim 1 further comprising a hydraulic pump and motor assembly for supplying hydraulic fluid under pressure to said piston and cylinder unit thereby to effect movement of said second pulley block with respect to said first pulley block.

5. A boat dock and lift as set forth in-claim 1 wherein said movable pulley block is movable through a stroke corresponding to the stroke of said cylinder unit, and wherein said movable pulley block is movable along said cross member a distance greater than the distance effected by actuation of said hydraulic cylinder unit through its full stroke, and wherein said lift is capable of movement relative to said frame a distance greater than the distance said lift is moved by said hydraulic cylinder arrangement such that loads substantially is excess of the weight of said lift and the load carried thereby are lifted by said piston and cylinder unit.

* * * * *